United States Patent [19]

Krieps

[11] Patent Number: 4,843,857

[45] Date of Patent: Jul. 4, 1989

[54] METHOD OF FORMING A BULGE IN THE ROTARY TUBE OF A LOCKING MECHANISM

[75] Inventor: George D. Krieps, Wauconda, Ill.

[73] Assignee: White Welding and Mfg., Inc., Kenosha, Wis.

[21] Appl. No.: 157,189

[22] Filed: Feb. 18, 1988

[51] Int. Cl.[4] ..... B21D 39/08

[52] U.S. Cl. ..... 72/58; 29/447; 29/507; 29/523; 29/525; 72/342

[58] Field of Search ..... 29/447, 507, 523, 525; 72/342, 58; 49/346, 347, 367

[56] References Cited

U.S. PATENT DOCUMENTS

| | | | |
|---|---|---|---|
| 3,198,926 | 3/1965 | Melmoth | 72/342 X |
| 3,329,456 | 7/1967 | Orlander . | |
| 3,756,671 | 9/1973 | White | 308/15 |
| 3,813,117 | 5/1974 | Hackney et al. | 292/54 |
| 4,014,138 | 3/1977 | White | 49/367 |
| 4,068,409 | 1/1978 | White | 49/367 |
| 4,265,102 | 5/1981 | Shimakata et al. | 72/58 |
| 4,727,641 | 3/1988 | Kanatani et al. | 72/342 |
| 4,748,836 | 6/1988 | Hoeboer et al. | 72/58 |

*Primary Examiner*—Timothy V. Eley
*Assistant Examiner*—Peter D. B. Vo

[57] ABSTRACT

In a rotary tube locking mechanism, the rotary tube itself is bent to form a controlled bulge. The guide plate cooperates with this controlled bulge to provide an anti-racking function.

1 Claim, 3 Drawing Sheets

METHOD OF FORMING A BULGE IN THE ROTARY TUBE OF A LOCKING MECHANISM

FIELD OF THE INVENTION present invention relates generally to anti-racking for the doors of cargo containers and more particularly to an anti-racking device whose fabrication lends itself to automation.

Cargo containers and the like having enclosed bodies are conventionally provided with a rectangular door frame, a pair of doors which are adapted to be swung within the plane of the door frame closing the latter, and rotary bar locking mechanism for selectively retaining the doors within the door frame. The door frame comprises horizontal top and bottom frame members and vertical side frame members suitably welded at their adjacent corner ends. As is more and more true in today's world, for purposes of economy, the container (including the door frame) is usually fabricated of structural members having the least strength practical, and the doors are normally fabricated of plywood faced with an inner and outer aluminum skin.

Because of the weakness of the structural members, the door frame is subject to considerable distortion when racking forces are applied to the container. The door frame is partially reinforced by the doors, and the frame and doors may be further reinforced by the rotary locking mechanism. That is, normally, because of the nature of the construction anti-racking means are incorporated into the rotary locking mechanism. As the prior art reflects, there are various types of anti-racking means provided to reinforce the rear portion of the cargo container. Such prior art devices vary in their complexity and cost with the over-all objective being efficiency and economy.

SUMMARY OF THE INVENTION

It is an object of the present invention to provide anti-racking means for cargo containers and the like which will provide an auxiliary reinforcement for the doors and the door frame and whose fabrication can be very economically automated.

The anti-racking means of the present invention comprises a controlled bulge hot or cold forged out of the rotary locking tube itself. The hot forged anti-racking ring is created in the rotary locking tube at a point such that when the doors are locked it abuts with a bearing surface located on the guide plate portion.

In a preferred embodiment, a rotary locking tube which has been pre-cut to a desired length is inserted into a fixture, and then folded back upon itself to form a controlled displacement, bulge or ring-like protuberance around the circumference thereof.

DESCRIPTION OF THE PREFERRED EMBODIMENTS

Figure 1:
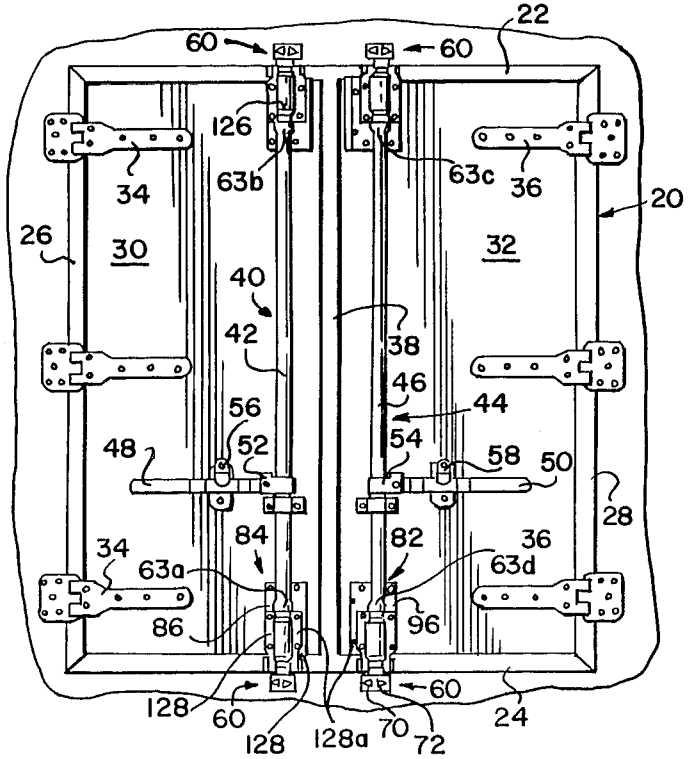
FIG. 1 is an elevational view of a typical door frame.

Referring now to FIG. 1, there is indicated generally by the reference number 20 a conventional door frame which may be, for example, located at the rear end of the body of an enclosed cargo container. The door frame 20 comprises horizontal upper and lower structural elements 22 and 24 and vertical side structural elements 26 and 28. Disposed within the door frame 20 for closing the same are a pair of doors 30 and 32 which are vertically hinged to the side door frame elements 26 and 28 by means of hinges 34 and 36. To provide a suitable seal enclosure, resilient strip material 38 of generally H-sectional configuration may be secured above the edges of the doors 30 and 32, with the strip material along the vertical free edge of the door 32 being arranged to overlap the vertical free edge of the door 30.

The door 30 is adapted to be secured within the door frame 20 by means of a rotary tube door locking mechanism 40 including the vertically disposed rotary locking bar or tube 42, while the door 32 is adapted to be secured within the door frame 20 by means of rotary tube door locking mechanism 44 which includes the vertically disposed rotary tube 46. Means for rotating the locking tubes 42 and 46 are provided in the form of revolvable elements or handle levers 48 and 50 pivotally mounted to brackets 52 and 54, and secured to the tubes 42 and 46 respectively. The hand levers 48 and 50 are normally retained in sealed assembly or retainer means 56 and 58. Arranged for association with each of the upper and lower ends of the rotary door locking tubes 42 and 46 are keeper members 60 secured to the upper and lower door frame elements 22 and 24; additionally associated with the respected upper and lower pairs of ends of rotary tubes 42 and 46 are anti-racking means 63*a, b, c* and *d*. Each anti-racking means is identical and thus discussion will be generally limited to one shown in FIG. 2 with the understanding that it applies equally well to all the others.

Figure 2:
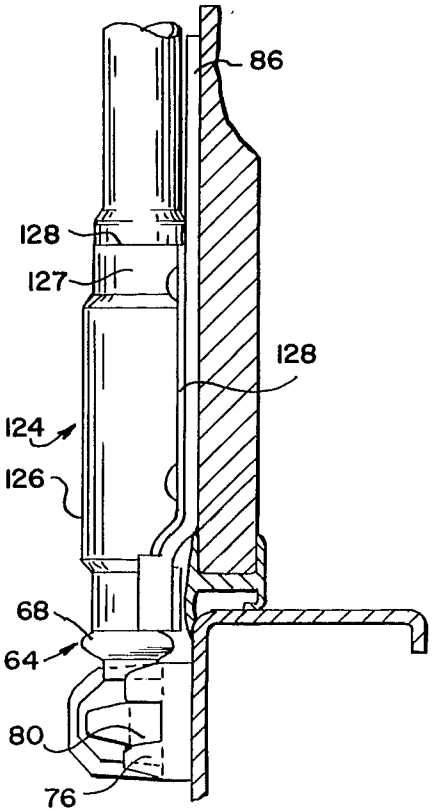
FIG. 2 is a veratical enlarged view of the guide plate anti-racking means.
Figure 6:
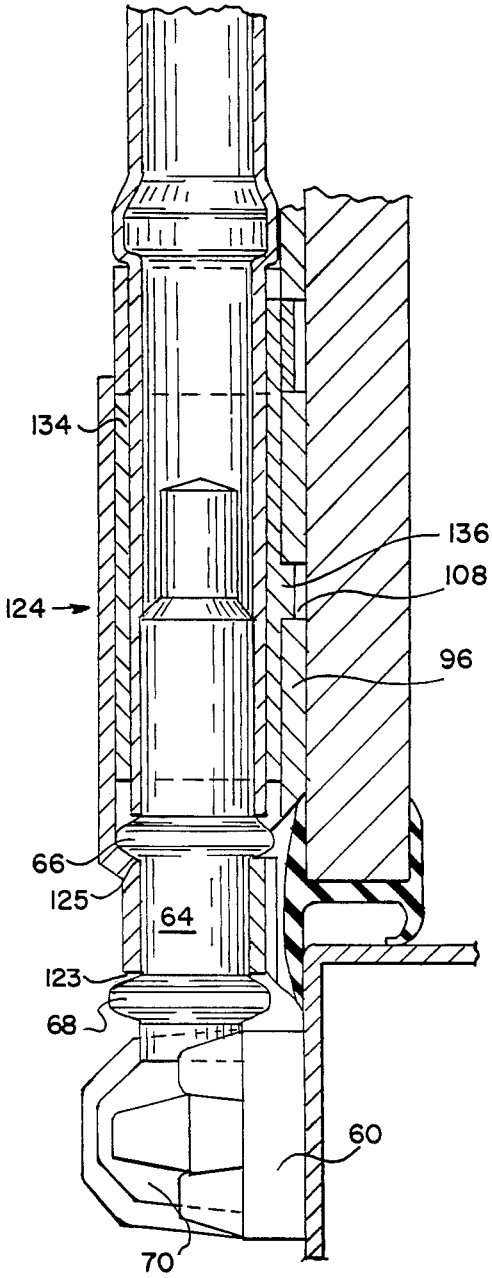
FIG. 6 is a vertical sectional view of the anti-racking means rotary tube locking mechanism.

Each locking tube 42 and 46 has secured in each end thereof a separate bar end, such as 64, one of which is shown in FIG. 2 and FIG. 6. Each bar end 64 includes a pair of axially spaced annular collars 66 and 68 and a pair of generally radial extending arm portions 70 and 72. Each keeper member 60 has laterally spaced forwardly extending projections wherein the locking bar arm portion is adapted to be engaged or received respectively.

Each rotary tube door locking mechanism 40 and 44 also includes a pair of brackets 82 and 84.

The brackets 82 and 84 are substantially identical in configuration and any discussion applies to both. Each base portion 86 and 96 are secured to its respective door and are provided with an intermediate bore through which passes the rotary tube. In association with each base portion is a guide plate or bearing bracket 124 characterized by a generally semi-cylindrical vertically disposed central portion 126 and a pair of side flanges 128 and 128*a*. The top edge of the central portion 126 is necked down as at 127 to create a bearing surface 129.

The side flange 128 and 128*a* and the adjacent base portions 86 or 96 are suitably secured to the adjacent door by means of bolts. A vertical split bearing 134 may be mounted in each front guide plate 124 with a boss portion 136 of each located at the base portion bore 108. The end of the locking tube 42 is accommodated between the front guide plate 124 and the respective bracket portion 96 which serves as a backing plate. The locking bar collars 66 and 68 bear against the end surfaces 123 and abutments of the guide plate 125. Thus, the arrangement of the collars and the abutments restrain the four different ends of the locking tubes 42 and 46 and portions of any axial racking forces exerted on the ends of the locking bars 42 and 46 are transmitted to the associated hardware to the doors 30 and 32.

As is apparent, the locking bar collars 66 and 68 are formed in and a part of the bar end 64. The entire assembly is a solid forged piece which during the fabrication of the locking bar is press fit and welded into the locking tube. The collars 66 and 68 thus are forged from the solid parent section.

Figure 5:
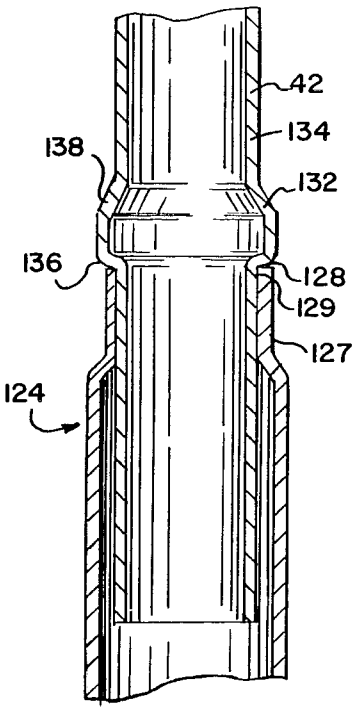
FIG. 5 is a vertical sectional view of the anti-racking means.

Referring now to FIG. 5 wherein is shown a preferred embodiment of my anti-racking means. It should be appreciated that therethat there is another prior art anti-rack device which is very similar in nature. This prior art anti-rack device includes a large steel ring which slipped over the end of a rotary tube and then welded in place. The particular location of the welded tube is such that it cooperates with the bearing surface 128 as shown in FIG. 5. However, it is apparent with any device wherein a series of parts must be first assembled and then welded, the opportunity for error exists either in tolerance stack-ups or quality control. Additionally, the assembly of individual parts does not lend itself to low cost automation. The embodiment as shown in FIG. 5 achieves all of the advantages of the prior art devices (assuming they have been made correctly), yet lends itself to automation whereby quality control can be exactly controlled. In its simplest form, the invention consists in providing both ends of the locking tube 42 with a ring-like protuberance or controlled bulge 132. As is apparent, FIG. 5 shows only one controlled bulge 132 in detail. However, FIG. 1 shows each in their proper environment. Thus, it is understood that a discussion of one will apply equally to all of the others.

The anti-racking means as shown in FIG. 5 includes the controlled displacement or bulge portion 132 which cooperates with the neck-down portion 127 of the guide plate 124. Particularly, the controlled displacement portion 132 consists of a portion that provides a bearing surface made up of an actual part of the wall of the rotary locking tube 42. The bearing wall portion 136 has been displaced into a plane which is generally perpendicular to the major plane which extends the length of the locking tube 42. This penpendicularlly displaced wall portion 136 thus provides the bearing surface for cooperation with the bearing surface 129 on the guide plate. A second portion of the controlled bulge 132 is the support structure means 138 which is located directly adjacent to the vertically displaced wall portion and provides support whereby the racking forces can be resisted. As is apparent, the control bulge can be of any general shape and configuration as long as a bearing surface means and a support structure means are provided, both of which being an integral portion of the tube wall 134.

Figure 3:
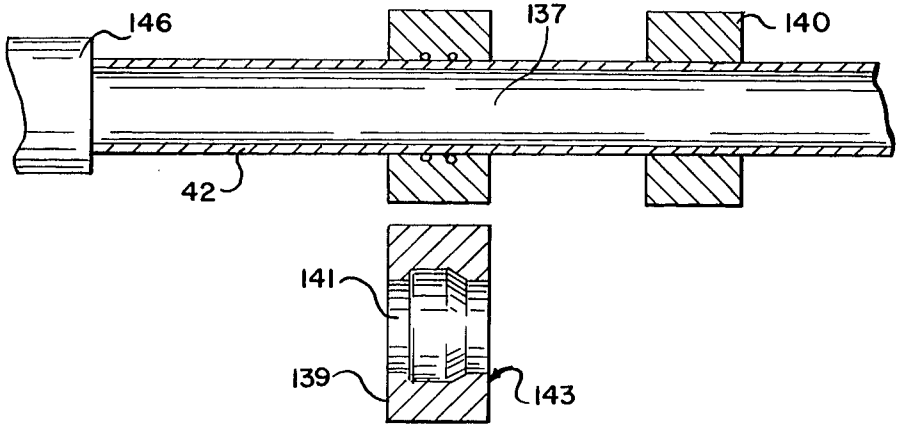
FIGS. 3–4 show the steps according to the method of the invention for the generation of a controlled bulge.
Figure 4:
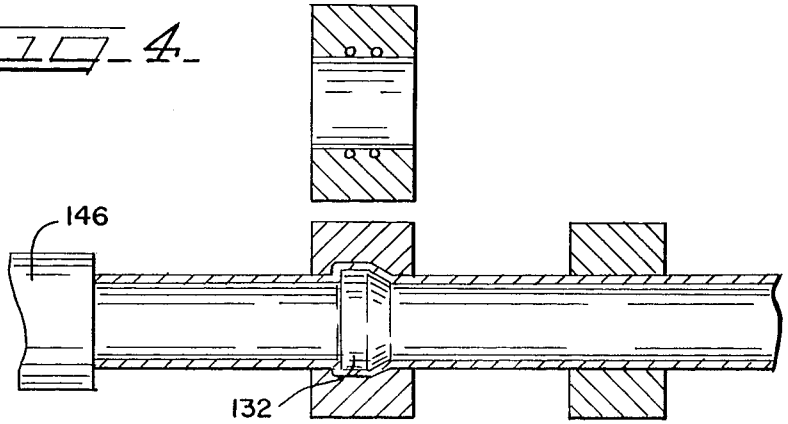

Referring now to FIGS. 3 and 4, wherein one general method for the generation of a controlled bulge such as 132 can be formed. The first step includes the securing of a tube 42 against movement along its major axis. As is apparent, the securing means 140 is located inwardly from the point where the controlled bulge will be formed. A securing device such as 140 would be used adjacent either end of the tube in the manner shown in FIG. 3 and any suitable device would be acceptable. Next, in a preferred embodiment, heating of a predetermined portion of the tube, such as 137, takes place sufficient to create a zone of hot tube wall. In a preferred embodiment, the full circumference or 360 degrees around the tube is heated. The size of the zone, as well as the temperature to which the tube must be heated, as well as the type of device employed to generate the necessary heat will depend on various factors within the general knowledge of one skilled in the art. Depending on these factors, heating of the tube wall itself may be reduced to minimal levels.

Once the tube wall is heated, the heating means is removed and adjacent said hot tube wall a mold, such as 139, or means for receiving and shaping hot metal is positioned. In the preferred embodiment this means for receiving and shaping hot metal 139 completely encircles said tube and functions in a generally clam-shell mode. The center portion 141 thereof has been cut to provide a cavity 143 which reflects the desired contour of the controlled bulge into which the hot tube wall will be shaped. Depending upon particular conditions, it may or may not be desirable to employ a mandrel such as one of 44 shown located in the bore of the tube 42. The mandrel allows or prevents any hot tube wall from flowing inwardly during the compression or forming step.

The next step in the preferred embodiment is performed by a hydraulic ram 146 which compresses or forces said tube in a lengthwise direction or along its major axis whereby the tube wall material folds into and fills the cavity 143 provided in the mold. As previously stated, the size of the hot zone is determined by the shape of the final controlled bulge means. This, in turn, reflects back upon the stroke through which the hydraulic ram 146 passes. However, a critical feature of the final product is that particular dimensions of the rotary locking tube 42 itself must be sized to an exact length. At this point, the first and second controlled bulges, such as **63*a* and 63*b***, are positioned with respect to the final assembly. All of various tolerances and values are exactly controlled by the automated nature of the manufacturing process. There is little margin for error either in tube length or positioning a steel ring with subsequent welding. Even minor differences in tube length, either positive or negative, are corrected for such that a rotary locking tube of exact, precise, predictable measurements is produced.

I have thus provided a rotary tube door locking means which includes a novel anti-racking means and a novel method for producing same. The anti-racking result is achieved by displacing a portion of the tube wall such that a bearing surface is created which has a major plane generally perpendicular to the major plane extending down the center of the rotary tube itself. Other portions of the wall are displaced to provide a support portion for the bearing surface portion. The bearing surface cooperates and is coplanar with a bearing surface provided on the guide plate which in turn is secured to the door of the cargo container. In a preferred embodiment I provide four anti-racking means, one at each end of the two rotary locking tubes. However, depending upon circumstances, it may be possible to achieve suitable results using only two.

While there have been shown and described preferred embodiments of the present invention, it will be understood by those skilled in the art that various rearrangements and modifications may be made therein without departing from the spirit and scope of the invention.

I claim:

1. A method for manipulating the hollow rotary tube of a rotary tube locking mechanism to form a controlled bulge which provides an anti-rack function in cooperation with a guide plate comprising the steps of:

securing a hollow rotary tube having a length in excess of that when finished and a major plane extending down the center thereof;

heating a predetermined portion of said hollow rotary tube to create a zone of hot tube wall about 360 degrees around said tube;

positioning adjacent said hot tube wall a means for receiving and shaping hot metal;

compressing said tube in a lengthwise direction; and displacing said hot tube wall filling said means for receiving and shaping hot metal with displaced hot tube wall, thereby creating a controlled bulge having a supporting portion and a bearing surface, said bearing surface having a major plane generally perpendicular to said major plane of said hollow rotary tube.

* * * * *